United States Patent [19]

Patton

[11] Patent Number: 4,606,666

[45] Date of Patent: Aug. 19, 1986

[54] PAPER BINDER

[76] Inventor: David D. Patton, 9109 Industrial Ct., Gaithersburg, Md. 20877

[21] Appl. No.: 592,463

[22] Filed: Mar. 22, 1984

[51] Int. Cl.[4] ..... B42F 13/14

[52] U.S. Cl. ..... 402/62

[58] Field of Search ..... 402/60, 61, 62, 63

[56] References Cited

U.S. PATENT DOCUMENTS

| | | | |
|---|---|---|---|
| 3,340,635 | 9/1967 | McIntosh | 402/63 X |
| 3,970,331 | 7/1976 | Giulie | 402/63 X |

FOREIGN PATENT DOCUMENTS

| | | | |
|---|---|---|---|
| 950768 | 2/1964 | United Kingdom | 402/80 P |
| 1225829 | 3/1971 | United Kingdom | 402/80 P |
| 2065555 | 7/1981 | United Kingdom | 402/63 |

*Primary Examiner*—Paul A. Bell

[57] ABSTRACT

A paper binder or holder for retaining loose leaf paper sheets, folders, technical bulletins, advertisements and the like in assembled and stacked relation. The device includes a bottom or base strip having a plurality of upstanding pegs integral therewith and which are arranged in spaced parallel relation and provided with peripheral serrations. The pegs extend through apertures in the edge of the paper sheets and also extend through apertures in a clamping bar or strip which engages the upper surface of the top paper sheet. Each aperture in the retaining strip has a tongue which engages the peg by engaging under the serrations to lock the clamping bar in clamped position against the top paper sheet. The entire device is constructed of plastic to enable the cost of manufacture to be retained at a minimum.

2 Claims, 4 Drawing Figures

PAPER BINDER

FIELD OF THE INVENTION

The present invention generally relates to a loose leaf paper sheet binder or holder and more specifically to a binder constructed of plastic material of two piece construction with one piece being in the form of a base strip with a plurality of upstanding serrated pegs or posts and the other piece being a clamp or retaining bar having apertures receiving the pegs in which each aperture is provided with a tongue which engages the serrations on the pegs to lock the clamping bar in position on the pegs by enabling generally unrestricted downward movement and preventing upward movement.

DESCRIPTION OF THE PRIOR ART

Various devices have been developed by which loose leaf sheets of paper are retained in assembled and stacked relation including multiple ring notebook paper binders, metal clips, screw threaded telescopic posts and the like. However, while such devices are used and are effective in certain uses, such devices, in some instances, are rather costly to manufacture, difficult to manipulate and ineffective in operation.

SUMMARY OF THE INVENTION

An object of the present invention is to provide a loose leaf sheet binder constructed of plastic material with one piece including a base and a plurality of projecting pegs or posts and the other piece including a clamping bar or strip having apertures receiving and lockingly engaging the pegs.

Another object of the invention is to provide a binder in which each of the pegs or posts have serrations and each aperture includes a tongue constructed to enable easy inward movement but preventing easy outward movement on the pegs.

A further object of this invention is to provide a binder in which the serrations incline downwardly while the tongue inclines upwardly to define a one-way clutch type of engagement of the tongue with the pegs.

Still another object of the invention is to provide a binder which is simple in construction, inexpensive to manufacture, easy to use and effective to hold loose leaf sheets in assembled and stacked relation.

These and other objects are advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
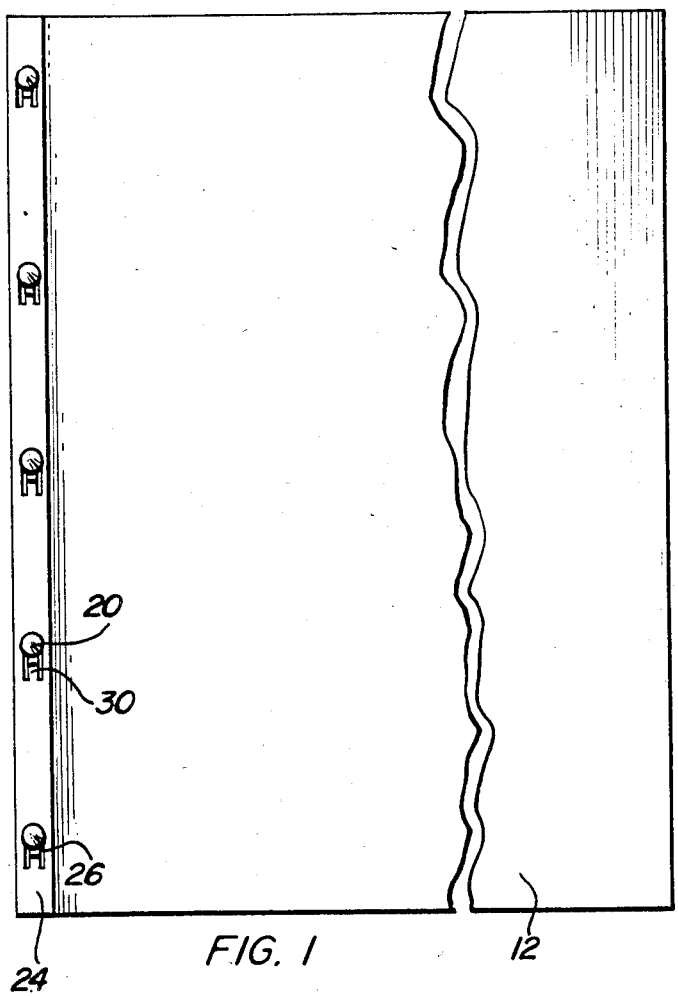
FIG. 1 is a plan view of the binder of this invention with a stack of loose leaf paper sheets.
Figure 2:
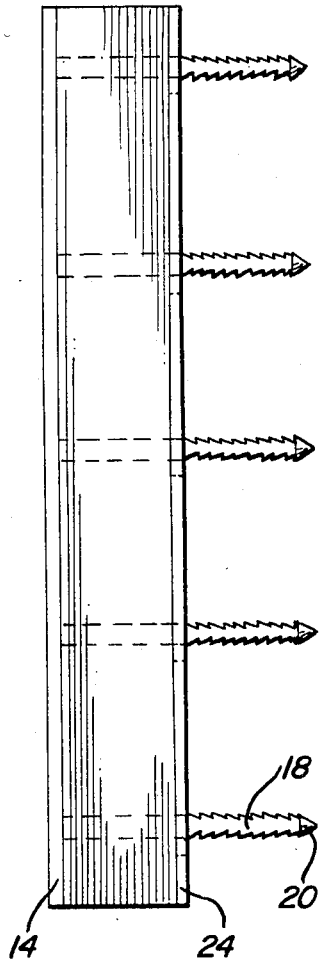
FIG. 2 is a side elevation thereof.
Figure 3:
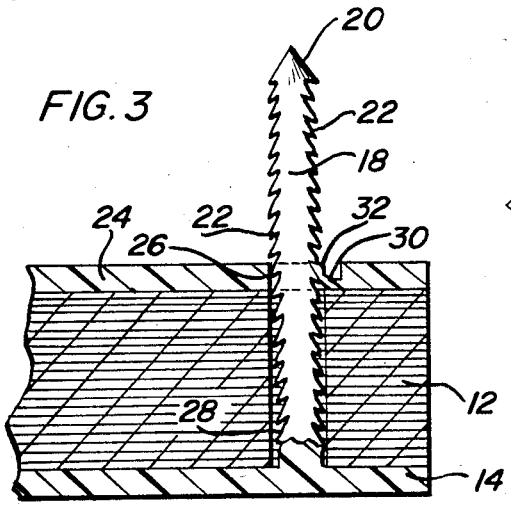
FIG. 3 is a sectional view of one segment of the binder.
Figure 4:
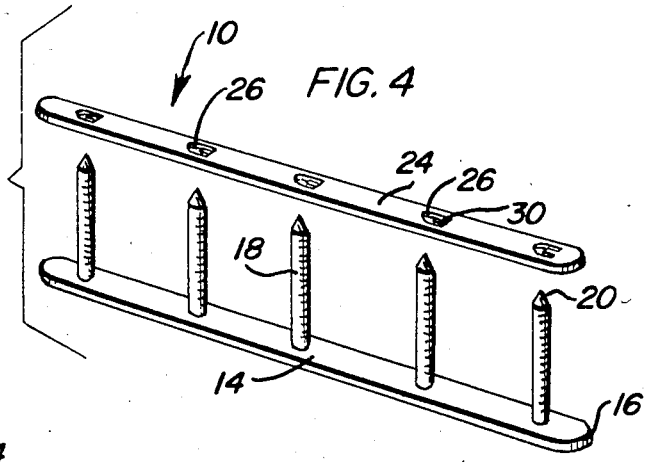
FIG. 4 is a group perspective view of the binder.

The binder of the present invention is designated by reference numeral 10 and is used to clampingly secure a plurality of loose leaf sheets 12 in assembled stacked relation to facilitate handling, storage and use. The binder 10 includes a narrow, elongated strip or bar 14 of substantially rigid plastic material. The strip 14 is relatively rigid and thin with rounded ends 16. The strip 14 has a plurality of pegs or posts 18 of unitary construction therewith at spaced intervals and with pointed upper ends 20 and serrations 22 throughout the length thereof with each serration being inclined downwardly as shown in FIG. 3.

The binder 10 also includes a clamping bar or strip 24 of generally the same shape and size as strip 14 and provided with a plurality of apertures 26 for receiving the pegs 18 which also extend through apertures 28 in the paper sheets 12. Each aperture 26 is provided with a tongue 30 and is generally rectangular or oval shaped with the tongue extending from one end having a pointed end and being inclined upwardly. The pointed end engages the serrations and locks the clamping bar 24 in clamped relation to the top sheet. The tongue 30 is integral with the lower edge of the aperture 26 and is thinner than the strip 24 and curves upwardly to form a flexible tongue which enables the strip 24 to be easily pushed downwardly onto the pegs but substantially precludes outward movement thereon thereby forming a one-way clutch engagement between the tongue and peg. By exerting sufficient force against strip 24, it can be moved upwardly by deforming the tongue 30. Also, the serrations may be formed completely around the pegs or on only one side thereof if desired. Both pieces of the binder may be constructed of plastic material using well known techniques.

The foregoing is considered as illustrative only of the invention and its principles. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed as new is as follows:

1. A binder for retaining a plurality of paper sheets in assembled and stacked relation in which the paper sheets have apertures formed therein, said binder comprising a base strip, a plurality of pegs extending upwardly from said strip, each of said pegs including a plurality of serrations, and a clamping strip having apertures receiving said pegs, and a single tongue extending into each aperture in the strip to engage the serrations to lock the clamping strip in adjusted position, each aperture being laterally elongated with the tongue extending from one end thereof, said tongue having a thickness substantially less than the clamping strip and being integral with and flush with the bottom edge of the aperture and extending inwardly and upwardly and terminating in a tapered upper end engaged with the serrations, the tapered upper end of the tongue terminating generally in the same plane as the upper surface of the clamping strip, said strips, pegs and tongues being of plastic material and of unitary construction.

2. The binder as defined in claim 1 wherein said serrations are inclined downwardly to enable easy movement of the tongue downwardly and prevent easy movement of the tongue upwardly.

* * * * *